US005178295A

United States Patent [19]

Crumrine et al.

[11] Patent Number: 5,178,295

[45] Date of Patent: Jan. 12, 1993

[54] CONTAINER WITH INTEGRAL RACKING SLOT

[76] Inventors: Douglas L. Crumrine, 533 Linden Ave., Grand Island, Nebr. 68801; Rodney Laible, R.R. 1, Box 37, Bennington, Nebr. 68807

[21] Appl. No.: 647,353

[22] Filed: Jan. 29, 1991

[51] Int. Cl.[5] ..... B65D 1/24; B65D 1/36

[52] U.S. Cl. ..... 220/523; 220/4.22; 220/553; 220/555; 220/342; 206/470; 206/806

[58] Field of Search ..... 206/315.11, 461, 467, 206/470, 806; 220/342, 343, 507, 523, 533, 555, 4.22, 304

[56] References Cited

U.S. PATENT DOCUMENTS

| | | | |
|---|---|---|---|
| D. 174,915 | 6/1955 | McGee | 206/315.11 |
| 2,935,188 | 5/1960 | Thomas | 220/343 |
| 3,174,621 | 3/1965 | Watson | 206/470 |
| 3,394,801 | 7/1968 | Hawson | 206/470 |
| 3,463,309 | 8/1969 | Szostek | 206/470 |
| 3,581,885 | 6/1971 | Wald | 206/470 |
| 3,639,021 | 2/1972 | Fee | 206/315.11 |
| 3,699,083 | 6/1976 | Hoffman et al. | 220/306 |
| 4,058,220 | 11/1977 | Torongo | 206/806 |
| 4,258,857 | 3/1981 | McGee | 206/806 |
| 4,327,512 | 5/1982 | Oliver | 206/806 |
| 4,493,433 | 1/1985 | Sideri et al. | 206/806 |
| 4,687,129 | 8/1987 | Cugley | 206/470 |
| 4,742,914 | 5/1988 | Klein | 206/806 |
| 4,881,654 | 11/1989 | Stazo et al. | 206/315.11 |
| 4,887,790 | 12/1989 | Wilkinson et al. | 220/507 |
| 4,892,189 | 1/1990 | Kunimune et al. | 220/342 |
| 4,998,424 | 3/1991 | Lambert, II | 206/806 |

FOREIGN PATENT DOCUMENTS

| | | | |
|---|---|---|---|
| 2222144 | 2/1990 | United Kingdom | 220/343 |

*Primary Examiner*—David T. Fidei
*Attorney, Agent, or Firm*—John A. Beehner

[57] ABSTRACT

A small parts container includes a top wall, bottom wall and peripheral sidewall connected to define a parts containing chamber. A moveable lid affords access to parts in the container. Aligned openings are provided through the top wall and bottom wall and an internal generally tubular wall surrounds those openings for defining a rack member receiving slot through the container.

13 Claims, 2 Drawing Sheets

CONTAINER WITH INTEGRAL RACKING SLOT

BACKGROUND OF THE INVENTION

The present invention is directed generally to an improved parts container and more particularly to such a container having a rack member receiving opening through the parts chamber therein for space efficient packing and display of the containers.

Small containers are used in connection with the packaging and sales of many different types of parts, such as fishing tackle, including leaders, swivels, weights, bobbers and the like and hardware, including nuts, bolts, washers, electrical fittings and the like. The container of these parts is generally blister wrapped or shrink wrapped onto a header card which extends above the container and has a hole for supporting the card on a rack wire of a typical retail store rack.

Whereas the containers provide convenient storage for selling a plurality or assortment of parts as a unit, they have several disadvantages. First, since parts containers are generally not supportable on the rack wires of a retail display or user's workbench, a header card is generally required which, after it is removed, destroys the capability of supporting the containers to be supported on the rack wires. Certain containers are provided with an integral external flange having the rack wire receiving opening therein but that flange extends the dimensions of the container in at least one direction with no corresponding increase in storage capacity for the container. The flange interferes with efficient packing of the containers for storage and transport and requires sufficient separation between containers on display racks to provide room for the flanges.

Accordingly, a primary object of the present invention is to provide an improved parts container having a rack member receiving opening through the parts receiving chamber within the container.

Another object is to provide an improved parts container adapted for space efficient packing in boxes for storage and transport.

Another object of the invention is to provide an improved parts container which eliminates the need for a separate header card for retail display on rack wires and the like.

Another object is to provide an improved parts container which may be opened, closed and reracked on a rack wire.

Another object is to provide an improved parts container which enables the racked containers to be arranged in closely spaced relation for space efficient display.

Another object is to provide an improved method for storing and displaying parts.

Finally, another object of the invention is to provide an improved parts container which is simple and rugged in construction, economical to manufacture and efficient in operation.

SUMMARY OF THE INVENTION

The parts container of the invention is adapted for support on a rack member and includes a top wall, bottom wall and a peripheral sidewall defining a parts containing chamber. A container lid is moveable between closed and opened positions of providing access to parts in the container. The top and bottom walls have generally aligned openings therethrough and a generally tubular sleeve is connected to at least one of the top and bottom walls around the opening therein. The sleeve extends toward the other wall in general alignment with the opening therein so that the container may be supported on a rack member directed through both openings and the sleeve. The sleeve prevents parts from being lost through the top wall and bottom wall openings when the container is closed. It also facilitates guiding the containers onto a rack member without interference.

The top wall preferably serves as the lid and is pivotally connected to a base formed by the bottom wall and peripheral sidewall. A divider wall may be connected to and extended between the sleeve and peripheral sidewall both to structurally reinforce the sleeve and divide the chamber into a plurality of compartments. Additional subdivider walls may be added to divide the chamber into as many compartments as are desired.

The containers are thus self-supporting on a display rack wire and may be reracked any number of times during the long useful life of the containers. Since the rack member receiving opening is arranged within the confines of the peripheral sidewall of the container, there are no protrusions from the containers which would interfere with efficient packing of container into boxes for space efficient storage and transport.

DESCRIPTION OF THE PREFERRED EMBODIMENT

Figure 2:
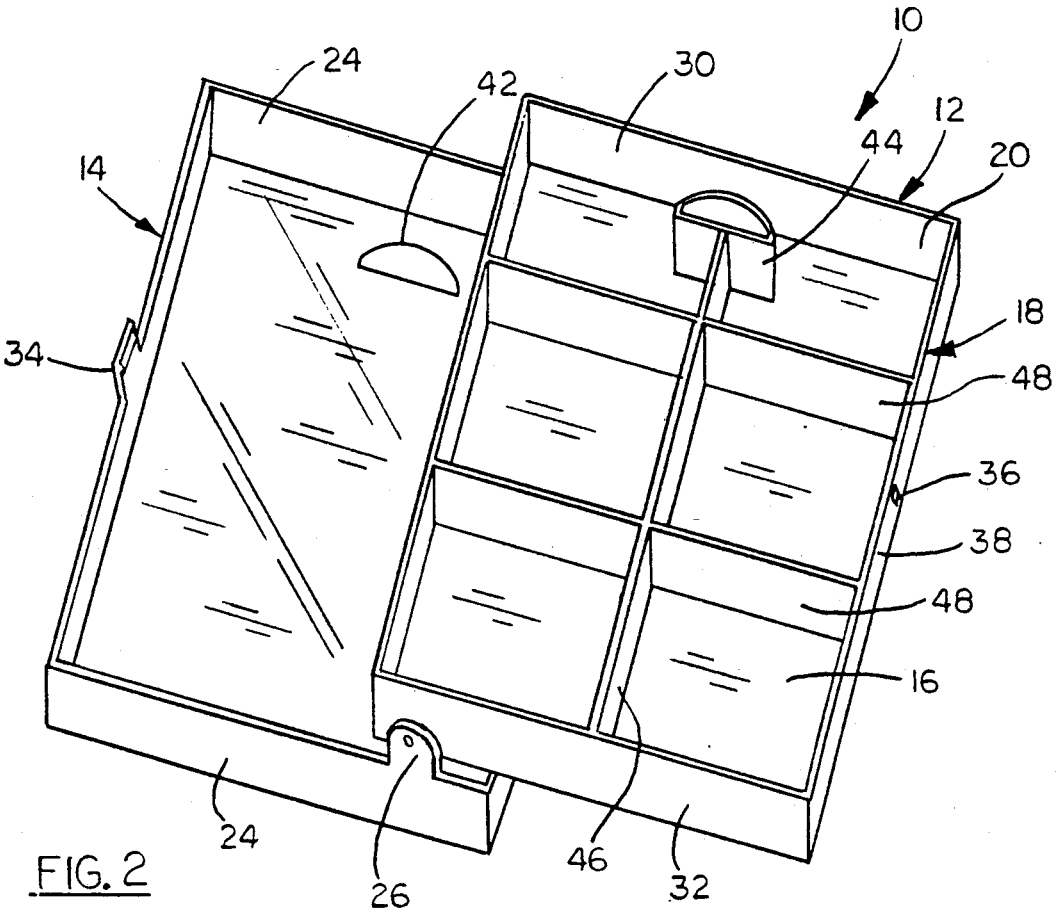
FIG. 2 is a perspective view of the parts container with the top wall pivoted to an open position.

The parts container 10 of the invention is illustrated in the drawings as including a base 12 adapted to be closed by a pivotal lid 14. Base 12 includes a bottom wall 16 and a peripheral sidewall 18 which is connected to and extended upwardly from the bottom wall so that the base defines a parts receiving chamber 20.

Figure 1:
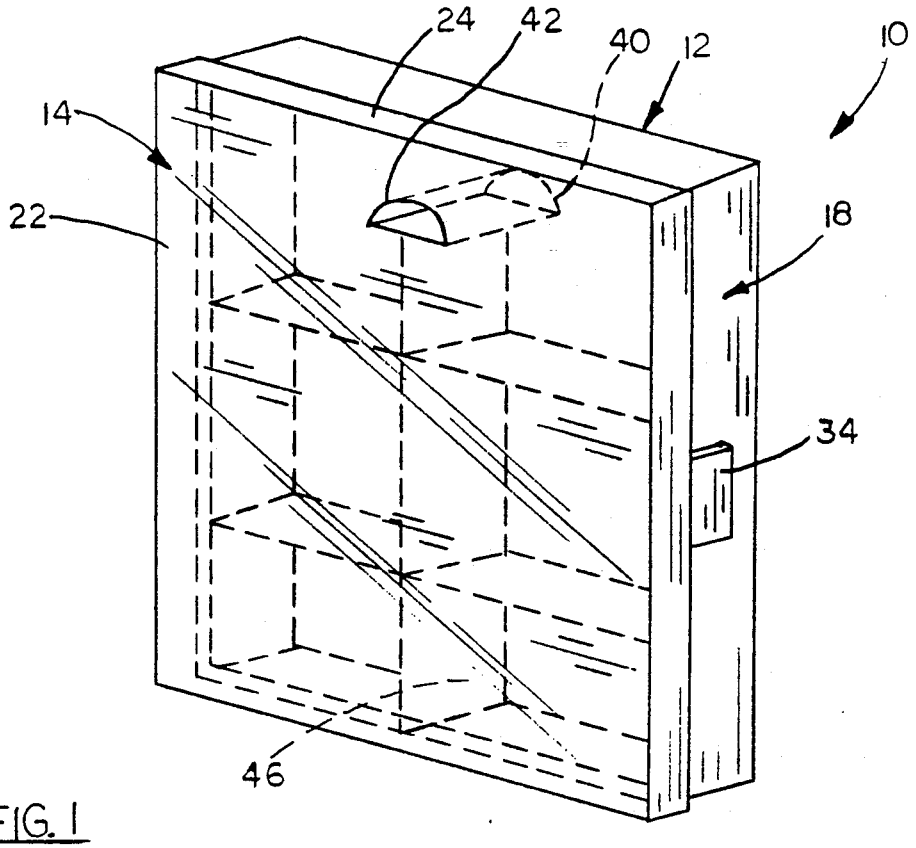
FIG. 1 is a perspective view of the improved parts container of the invention.
Figure 3:
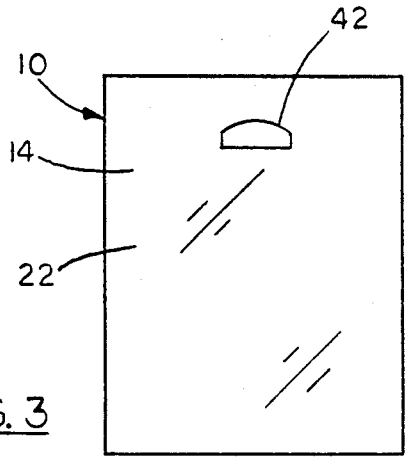
FIG. 3 is a top plan view of the parts container.
Figure 4:
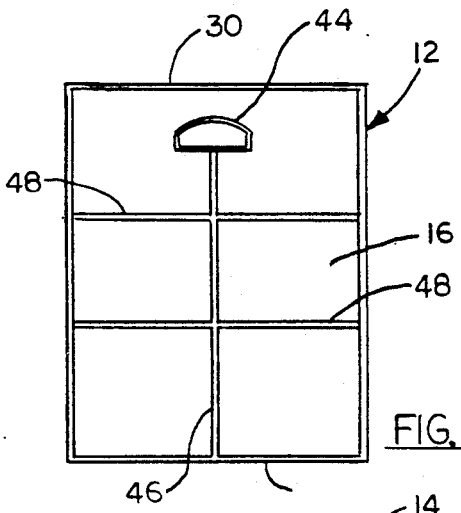
FIG. 4 is a top plan view of the base portion of the parts container.
Figure 5:
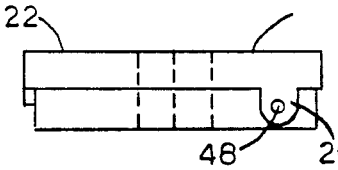
FIG. 5 is an end view of the parts container.
Figure 6:
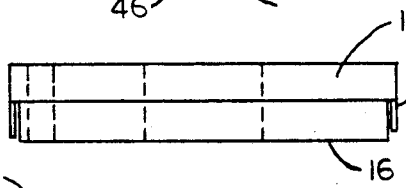
FIG. 6 is a side elevation view of the parts container.

The lid 14 includes top wall 22 which is of a size and shape for closing the open top of base 12. To connect the lid to the base for movement between closed and open positions, top wall 22 has a peripheral flange 24 with depending hinge arms 26 having holes for receiving pivot pins 28 on the end walls 30 and 32 of base 12. Lid 14 is thus pivotally moveable between the closed position of FIG. 1 wherein access to the chamber 20 is substantially blocked and the open position of FIG. 2 providing access to chamber 20 and any parts therein. Whereas a hinged connection between the top wall and base is illustrated, it is understood that the top wall could alternately be provided as a slide panel with connecting structure providing for sliding movement in either in a straight or pivotal path relative to the open top of base 12. Alternately, access to the container could be provided by an access opening through any of the walls thereof with a closure cap being provided for the access opening. The illustrated embodiment is preferred for providing maximum access to parts in the container.

In the illustrated embodiment, lid 14 is releasably secured in its closed position by a tab 34 on flange 24, which tab has a recess for engaging a shoulder 36 on one sidewall 38 of base 12.

Bottom wall 16 has a rack member receiving opening 40 adjacent one end, which opening is preferably aligned with a similarly shaped opening 42 through top wall 22 in the closed position of the top wall. A generally tubular wall or sleeve 44 is secured to bottom wall 16 around the periphery of opening 40, which sleeve extends upwardly for engaging top wall 22 in the closed position thereof to prevent the loss of parts through the openings 40 and 42. Sleeve 44 is preferably a continuous peripheral wall, but may include openings, slots, or other interruptions for reducing the weight or material of the container, or for venting chamber 20 if desired. Whereas sleeve 44 may be arranged in spaced relation from end wall 30, as illustrated in the preferred embodiment, it could alternately be formed as a U-shaped member which is closed by one end wall 30.

Chamber 30 may be subdivided by a divider wall 46 connected to and extended between sleeve 44 and peripheral sidewall 18. The compartments defined by divider wall 46 may be further subdivided by subdivider walls 48 extended between divider wall 46 and peripheral sidewall 18 thereby to define multiple compartments within base 12. The height of the peripheral sidewall 18, sleeve 44, divider wall 46 and subdivider walls 48 is preferably uniform so as to be closed and sealed by the top wall 22 upon movement of the lid to its closed position.

Figure 7:
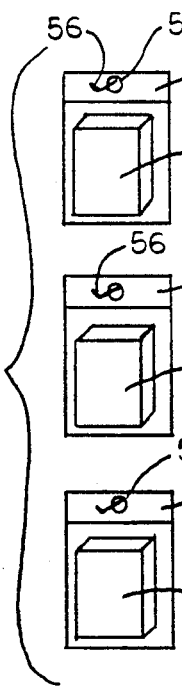
FIG. 7 is a diagrammatic view of prior art containers displayed on a retail rack.

An important advantage of the parts container of the invention is that it enables space efficient packing and display. In comparison, FIG. 7 illustrates typical prior art parts containers 50 which are blister wrapped or shrink wrapped onto header cards 52, each having a hole 54 for support on a typical retail store rack member or wire 56. Since the header cards 52 necessarily protrude outwardly from the containers 50 in at least in one direction, the containers are necessarily separated by at least the protruding dimension of the header card when the containers are stored on vertically spaced apart rack wires as illustrated in FIG. 7. Furthermore, the prior art containers 50 lose the capability of being reracked once the header cards are removed and discarded.

Figure 8:
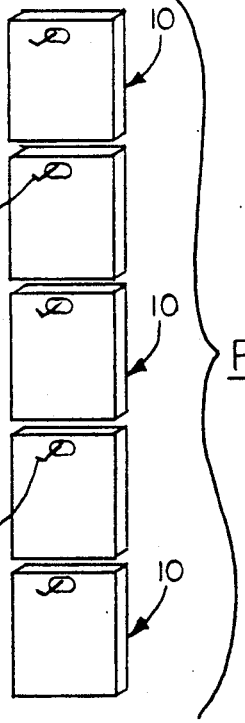
FIG. 8 is a diagrammatic view of the parts containers of the invention supported on a display rack.

These problems are resolved by the improved parts container of the invention. Referring to FIG. 8, a plurality of parts containers 10 may be racked in very closely spaced vertical relation since no protrusions from the containers are necessary for racking. Furthermore, when a container 10 is removed from the rack and opened and closed, it can be reracked since the rack receiving openings and sleeve are integral parts of the container itself. It is often advantageous for the purchaser to display the containers of fishing lures, hardware, or the like on a pegboard equipped with racking wires for ready access to the parts. The containers are preferably formed of a translucent or transparent plastic so that the parts therein are visible through the container.

For sealing, the containers prior to sale, a transparent film may be shrunk wrapped or otherwise adhesively secured around the container to prevent opening of the container prior to destruction of the film.

The invention is, therefore, furthermore, directed to a method of packing and displaying parts container for retail sale or storage, including providing a plurality of the containers, providing a display including a series of vertically spaced apart rack members, placing parts in the containers and supporting the containers on the rack members by directing a rack member through the rack member receiving opening of each container. Such method further envisions reracking containers after they have been opened and closed.

Whereas the invention has been shown and described herein in connection with a preferred embodiment thereof, it is understood that many modifications, additions, and substitutions may be made which are within the intended broad scope of the appended claims.

We claim:

1. A parts container adapted for support on a rack member, comprising, a substantially flat planar top wall, a substantially flat planar bottom wall and a peripheral sidewall connected to said bottom wall and extended upwardly therefrom for engagement with said top wall so that said walls define a chamber for containing parts, means for disengaging said top wall from said peripheral sidewall to insert and remove parts into and from said chamber, said top wall and bottom wall each having an opening therethrough, a single generally tubular wall means connected to said bottom wall and substantially surrounding the opening therein, said tubular wall means extending upwardly therefrom for engagement with said flat planar top wall in general alignment with the opening in said top wall to the extent that the container may be supported on a rack member directed through both openings and said tubular wall means, said generally tubular wall means further comprising a generally flat base and a pair of upwardly converging sides connecting at an apex whereby a rack member may be guided to rest at said apex of said generally tubular wall means formed by said upwardly converging sides, and said upwardly converging sides of said generally tubular wall means having the said upward extent as said peripheral sidewall and being spaced therefrom such that parts may be stored between said upwardly converging sides and said peripheral sidewall, thereby effectively utilizing space therein.

2. The parts container of claim 1 wherein said means for opening said container comprises means for movably supporting at least a portion of one wall for movement between an open position providing access to said chamber and a closed position wherein access to said chamber is substantially blocked.

3. The parts container of claim 2 wherein said means for moveable supporting at least a portion of one wall comprises means for pivotally connecting said top wall to said peripheral side wall and bottom wall whereby said top wall may be moved to an open position in clearance relation from the open top of a compartment defined by said sidewall and bottom wall.

4. The parts container of claim 1 wherein the openings through said top wall and bottom wall are arranged in alignment with respect to an axis directed perpendicularly to said top and bottom wall and through said openings.

5. The parts container of claim 1 wherein said tubular wall means comprises a substantially continuous wall free of openings therethrough.

6. The parts container of claim 1 wherein said container is made substantially of translucent plastic.

7. A parts container adapted for support on a rack member, comprising, a base including a substantially flat planar bottom wall and a peripheral sidewall connected to and extended upwardly from said bottom wall to define an open top chamber, a substantially flat planar top wall of a size and shaped to substantially close the open top of said chamber at times, means for movably connecting said top wall to said base for movement between a closed position substantially closing the open top of said chamber and an open position displaced from said open top for access to said chamber, said top wall and bottom wall each having an opening therethrough, a single generally tubular wall means connected to said bottom wall and substantially surrounding the opening therein, said tubular wall means extending upwardly therefrom for engagement with said flat planar top wall in general alignment with the opening in said top wall to the extent that the container may be supported on a rack member directed though both openings and said tubular wall means said generally tubular wall means further comprising a generally flat base and a pair of upwardly converging sides connecting at an apex whereby a rack member may be guided to rest at said apex of said generally tubular wall means formed by said upwardly converging sides, and said upwardly converging sides of said generally tubular wall means having the same upward extent as said peripheral sidewall and being spaced therefrom such that parts may be stored between said upwardly converging sides and said peripheral sidewall, thereby effectively utilizing space therein.

8. The parts container of claim 7 wherein said top wall and bottom wall are of similar size and shape and the respective openings therethrough are generally symmetrically positioned.

9. The parts container of claim 7 wherein said means for movably connecting said top wall to said base comprises pivotal hinge means.

10. The parts container of claim 9 further comprising coacting releasable fastener means on said top wall and base for releasably securing said top wall in the closed position thereof.

11. The parts container of claim 7 further comprising a divider wall connected to and extended between said tubular wall means and said peripheral sidewall to divide such chamber into a plurality of open top compartments.

12. The parts container of claim 11 further comprising subdivider walls connected to and extended between said divider wall and peripheral sidewall to further subdivide said compartments.

13. The parts container of claim 7 wherein said generally tubular wall means is positioned in spaced relation from said peripheral sidewall.

* * * * *